US005816088A

United States Patent [19]

Yamada et al.

[11] Patent Number: 5,816,088

[45] Date of Patent: Oct. 6, 1998

[54] SURFACE TREATMENT METHOD FOR A STEEL WORKPIECE USING HIGH SPEED SHOT PEENING

[75] Inventors: Yoshiro Yamada, Akashi; Masaaki Ishida; Kazuhiro Uzumaki, both of Toyota, all of Japan

[73] Assignees: Suncall Corporation, Kyoto; Kabushiki Kaisha Fuji Seisakusho, Edogawa-ku; Kabushiki Kaisha Fujikihan, Nagoya, all of Japan

[21] Appl. No.: 842,566

[22] Filed: Apr. 15, 1997

[30] Foreign Application Priority Data

Apr. 15, 1996 [JP] Japan ..... 8-092786

[51] Int. Cl.[6] ..... C21D 7/06

[52] U.S. Cl. ..... 72/53; 29/90.7

[58] Field of Search ..... 72/53; 29/90.7

[56] References Cited

U.S. PATENT DOCUMENTS

| | | | |
|---|---|---|---|
| 4,250,726 | 2/1981 | Safian et al. | 72/53 |
| 5,592,840 | 1/1997 | Miyasaka | 72/53 |

FOREIGN PATENT DOCUMENTS

| | | | |
|---|---|---|---|
| 3104-520 | 9/1978 | Japan | 72/53 |
| 0218-422 | 11/1985 | Japan | 72/53 |
| 1205-026 | 8/1989 | Japan | 72/53 |
| 2156-020 | 6/1990 | Japan | 72/53 |
| 4-99224 | 3/1992 | Japan | 72/199 |
| 5-140643 | 6/1993 | Japan | 72/53 |
| 6-41631 | 2/1994 | Japan | 72/53 |
| 6-145785 | 5/1994 | Japan | 72/53 |

*Primary Examiner*—David Jones
*Attorney, Agent, or Firm*—Nikaido, Marmelstein, Murray & Oram LLP

[57] ABSTRACT

Fatigue-resistance is significantly increased by performing shot peening using fine shots. A plurality of particles of hard metal having a diameter ranging from 20 to 100 micrometers are ejected onto a surface of a steel workpiece at an impinging speed greater than 80 m/second. The impinging speed is controlled so that the upper limit of temperature rising of the surface of the workpiece is maintained at a temperature more than 150° C. but less than the temperature at which recovery recrystallization and austentizing of steel occurs.

13 Claims, No Drawings

SURFACE TREATMENT METHOD FOR A STEEL WORKPIECE USING HIGH SPEED SHOT PEENING

FIELD OF THE INVENTION

This invention relates to a surface treatment method for steel workpiece by means of a high speed shot peening using fine metal particles.

BACKGROUND OF THE INVENTION

Coil springs, such as valve springs of an engine or clutch springs, are usually subjected to a shot peening treatment, since they are required to have a fatigue-resistance. In such a shot peening, metal particles of steel (steel balls or cut wires) are used. The size of the metal particles generally ranges from 0.6 mm to 0.8 mm. Thus, metal particles of a relatively large size are ejected at a speed less than 100 m/sec. Such a shot peening treatment may cause insufficient result in terms of residual compressive stress on a surface of a workpiece, surface roughness, and surface hardness. Accordingly, a second stage shot peening is performed in which metal particles of a relatively small size (0.2 mm to 0.3 mm) are ejected at a speed less than 100 m/sec, in order to improve the workpiece in terms of residual compressive stress, surface roughness and surface hardness. It is also known that such a shot peening may be performed on a workpiece having been heated to a temperature of 150–400 degree Celsius, so as to further increase fatigue-resistance of the workpiece.

The area of residual compressive stress formed in the surface layer of a workpiece is, in general, deepened, as the particle size of shots (material to be ejected) is; increased. It is therefore effective to use shots having a diameter of 600 to 800 micrometers, in order to avoid fatigue breakage from a lump of nonmetallic inclusions, such as $Al_2O_3$ or $MgO.Al_2O_3$ (spinel) having a particle diameter of 20 to 40 micrometers, distributed at a depth of 0.2 to 0.5 mm below the surface layer of a workpiece.

It is noted, however, that, when shots of a larger particle size are used, irregularity of the surface of a workpiece (surface roughness) is increased. It is specifically noted that such a tendency is accelerated as the ejection speed becomes high. This causes easy breakage of a workpiece at locations adjacent to the surface of the workpiece.

In order to avoid the above-mentioned inconvenience, it is known to employ so called "two-stage shot peening" in which, first, a shot peening is performed using shots of a diameter of 600 to 800 micrometers, and then, a second shot peening is performed using shots of a smaller particle size ranging from 200 to 300 micrometers. By this, fatigue breakage from the surface of a workpiece may be prevented.

Another surface treatment method is also known in which fine shots of a diameter of 40 to 200 micrometers are ejected at an ejection speed equal to or more than 100 m/sec, so as to increase the surface temperature of a workpiece to a temperature equal to or above the $A_3$ transformation temperature of the workpiece (Japanese Patent Publication No. Hei-02-17607). This treatment method is intended to achieve very high surface hardness and fatigue strength, by utilizing structural change in the area adjacent to the surface of the workpiece by means of the heat treatment at a temperature equal to or above the $A_3$ transformation temperature, and high residual compressive stress by means of the shot peening.

It is noted, however, that such a high speed shot peening may easily cause a local, high-speed adiabatic shear band in the area of the surface layer of the workpiece. It is specifically noted that, when subcooled structure, for example, of martensite or bainite, is caused locally at the area of adiabatic shear band, tendency of breakage in such area is increased. This adversely influences the workpiece in terms of fatigue characteristics thereof.

SUMMARY OF THE INVENTION

The main object of the invention is to further improve fatigue characteristics of a workpiece by means of shot peening using fine shots.

In a shot peening generally performed on valve springs using shots having particle diameters of 0.6 to 0.8 mm, a peak of residual compressive stress and hardness is created at a depth of several tens of micrometers from the surface layer of a workpiece. This is effective in terms of preventing breakage from nonmetallic inclusions below the surface layer, but it is problematic in terms of surface roughness, as mentioned above. Thus, the fatigue-resistance is related in a complex manner to various factors including, for example, residual compressive stress, surface roughness, hardness, and kind of nonmetallic inclusion. It is therefore impossible to advantageously increase the fatigue-resistance when a countermeasure is taken by simply considering a particular factor.

The inventors have directed specific attention to the surface temperature of a workpiece during shot peening. Specifically, a plurality of particles of hard metal of a diameter ranging from 20 to 100 micrometers are controlled to be collided against the surface of a workpiece at a predetermined speed more than 80 m/sec, so that the surface temperature becomes a temperature more than 150 degree Celsius at which solubility of cementite ($Fe_3C$) is increased to a value higher that at room temperature, but recovery recrystallization and austenitizing of steel are not caused.

When fine particles of hard metal having a diameter ranging from 20 to 100 micrometers collide against the surface of a steel workpiece at a speed more than 80 m/sec, cementites in the surface layer of the workpiece are finely fractured. Temperature of such finely fractured cementites are increased to a temperature of more than 150, degree Celsius due to the exothermic phenomenon caused by plastic deformation of the surface of the workpiece upon collision. By this, the solubility of the cementites is increased, so that a portion of the fractured cementites is decomposed. Thus, dislocation motion is prevented, due to the segregation of carbon atoms to be freed from the crystal lattices of the cementites in dislocations in alpha iron caused by plastic deformation upon collision, i.e., the dislocation anchoring (locking) caused by so called "Cottrell atmosphere", whereby yield strength is increased. The outer-most surface layer of the workpiece is hardened by the above-mentioned mechanism. In accordance with the invention, it is also possible to maintain smoother surface roughness, since fine metal particles having a diameter of 20 to 100 micrometers are used. Furthermore, the peak of residual compressive stress and hardness is shifted to the outer-most surface layer and formed at an increased value, so that, in combination with the effect of the dislocation anchoring, the fatigue-resistance is increased.

In this regard, it is specifically noted that the upper limit of temperature rising for the surface of the workpiece due to the collision of fine particles be preferably maintained at a temperature below 450 degrees Celsius which is an upper limit in temperature of the dislocation anchoring, since the dislocation anchoring has a great temperature dependency.

It is noted that, when coarser particles having a diameter more than 100 micrometers are used, cementites are not fractured to a sufficient degree, even when such; particles are ejected at a higher speed more than 80 m/sec. Thus, satisfactory results may not be obtained in terms of residual stress and hardness of the surface, and improvement in fatigue strength. When fine particles having a diameter less than 20 micrometers are used, it is difficult to obtain an ejection speed more than 80 m/sec, even when the ejection is performed using air or another gas as a carrier.

The invention may be also performed in the following manner. A shot peening, as a first stage, is performed using shots of 0.6 to 0.8 mm. Then, a shot peening, as a second stage, is performed using shots of 0.2 to 0.3 mm. Thereafter, a high-speed shot peening according to the invention is performed, as a third stage, using fine particles. By this, residual compressive stress of an increased value may be applied to an extended area from a relatively shallow location below the surface layer to a location deep into the workpiece. The surface roughness and surface hardness are also improved by the shot peening of fine particles, so that the fatigue-resistance may be further improved.

DETAILED DESCRIPTION OF THE PREFERRED EMBODIMENTS

The invention will be explained below with reference to several embodiments. The shots (material to be ejected) to be used in the invention are particles of hard metal having a diameter ranging from 20 to 100 micrometers. Usually, steel balls or cut wires are used. Such fine metal particles are collided against the surface of a steel workpiece, such as a valve spring or a clutch spring, at a speed of more than 80 m/sec. Such a high-speed shot peening by means of fine particles is performed using air or another gas as a carrier. The degree of shot peening according to the invention is performed to obtain a coverage more than 100%. The degree of coverage exceeding 100% may be calculated in proportional relationship from the duration of shot peening.

The surface temperature is raised as the ejection speed or shot peeing speed is increased. It is noted, however, that the upper limit and lower limit of temperature raising are limited in the invention. Specifically, the minimum value in temperature rising is limited to 150 degree Celsius, and the maximum value in temperature rising is limited to a temperature less than that at which recovery recrystallization and austenizing of steel occur. The surface temperature of a workpiece is univocally determined by the size of metal particles to be ejected, the ejection speed, ejection duration and the type of a workpiece. Thus, the relationship between the above-mentioned factors and the temperature is preliminarily accumulated as control data, so that the ejection duration and the ejection speed may be controlled on the basis of such data.

In order to enhance the effect of preventing breakage from nonmetallic inclusions below the surface layer, it is desirable to use the shot peening by means of fine particles according to the invention in combination with shot peening by means of shots having a diameter more than 100 micrometers according to prior art, so as to perform so called "multistage shotting". For example, and as a case of two-stage shotting, shot particles of 100 micrometers to 1.0 mm are ejected on the surface of a steel workpiece, so as to apply residual compressive stress to an area 0.05 to 0.5 mm deep from the surface of the workpiece. Thereafter, the shot peening by means of fine particles according to the invention is performed. In a case of three-stage shotting, shot particles having a diameter more than 300 micrometers are ejected on the surface of a coil spring, such as a valve spring or a clutch spring. Then, shot particles greater than 100 micrometers and smaller than 300 micrometers are ejected, so as to improve the surface roughness of the workpiece and residual compressive stress. Thereafter, the shot peening by means of fine particles according to the invention is performed.

For a workpiece having a relatively reduced thickness, such as a thin plate spring, it is not necessary to apply residual compressive stress to an area deep in the workpiece, since the stress gradient within the workpiece is steep. It is therefore desirable to eject or use relatively small metal particles having a diameter of 20 to 60 micrometers, for example.

For a workpiece requiring a specifically increased residual compressive stress, it is preferable to perform so called "stress peening" in which shot peening is conducted on a workpiece to which external stress is exerted.

With regard to a valve spring or a clutch spring, it is possible to reduce the degree of permanent set fatigue, by performing cold setting or warm setting so as to apply residual stress thereto, after conducting shot peening on the single spring.

If desired, cold tempering (for example, at a temperature of 230 degrees Celsius) may be performed on a spring which has been treated with a high-speed shot peening using metal particles of a diameter less than 100 micrometers (preferably, 20 to 60 micrometers). It is noted that, in accordance with the shot peening by means of fine particles, it is possible to perform a kind of partial cold tempering in which the workpiece is cooled when only the surface of the workpiece has been raised in temperature to 150 to 450 degree Celsius. Thus, for a workpiece which is required to be increased in toughness in its surface layer but which is not required to be increased in toughness in its central portion, it is possible to obviate such cold tempering.

EXAMPLES (1) The steel workpiece used in the following Example 1 and Comparative 1 is a coil spring, JIS SWOSCV, having a diameter of 4.5 mm.

Example 1

The following two-stage shot peening was performed.

(1) First shotting;

Wire cuts of a diameter of 0.6 mm were ejected at an ejection speed v=70 m/sec, while presetting the coverage at 300%.

(2) Second shotting;

Steel shots of a diameter of 0.3 mm were ejected at an ejection speed v=80 m/sec, while presetting the coverage at 200%.

(3) Third shotting;

Steel shots of an average diameter of 40 micrometers were ejected at an ejection speed v=80 m/sec, while presetting the coverage at 400%.

During the third shotting, the upper limit of the surface temperature of the workpiece was controlled at a temperature between 150 and 450 degree Celsius.

(4) Fatigue strength;

Test was performed to a repeat number of 3×107 using a star testing machine.

As a result, fatigue strength of 686±637 (MPa) was obtained.

Comparative 1

(1) First shotting;

Wire cuts of a diameter of 0.6 mm were ejected at an ejection speed v=70 m/sec, while presetting the coverage at 300%.

(2) Second shotting;

Steel shots of a diameter of 0.3 mm were ejected at an ejection speed v=80 m/sec, while presetting the coverage at 200%.

During the first and second shottings, the upper limit of the surface temperature of the workpiece is controlled to a temperature between 150 and 450 degree Celsius.

(3) Fatigue strength;

Test was performed to a repeat number of 3×107 using a star testing machine.

As a result, fatigue strength of 686±588 (MPa) was obtained.

Comparison in fatigue strength:

Fatigue strength of Example 1 is 686±637; and

Fatigue strength of Comparative 1 is 686±588.

It is appreciated that the fatigue strength of Example 1 is increased by the amount of 637=588=49 (MPa).

The steel workpiece used in the following Example 2 and Comparative 2 is a thin plate spring formed from a sheet obtained by cold rolling of Si-Cr steel for a valve spring. Two hundreds 200) of such thin plate spring were prepared.

Specifically the thin plate spring was prepared by the following steps.

surface grounding of Si-Cr steel for a valve spring→lead patenting (annealing)→acid pickling→wire drawing→flat rolling (sectional dimension: 1.4 mm thick×5.5 mm wide, average sectional hardness: Hv=540)→coiling.

Example 2

(1) Following shot peening was performed.

Steel shots of a diameter of 0.05 mm were ejected at an ejection speed v=180 m/sec using compressed air for ejection time t=13 sec, while presetting the coverage at more than 100%.

During the above process, the upper limit of the surface temperature of the workpiece was controlled to a temperature between 150 and 450 degree Celsius.

(2) Fatigue strength;

Fatigue limit test was conducted setting the fatigue limit number at 108 under the condition of average stress= amplitude stress. As a result, $\sigma max=165$ kgf/mm$^2$ was obtained.

Comparative 2

(1) Following shot peening was performed.

Steel shots of a diameter of 0.3 mm were ejected at an ejection speed v=80 m/sec using an impeller for ejection time t=30 min., while presetting the coverage at more than 100%.

During the above process, the upper limit of the surface temperature of the workpiece was controlled to a temperature between 150 and 450 degree Celsius in the present invention.

(2) Fatigue strength;

Fatigue limit test was conducted setting the fatigue limit number at 108 under the condition of average stress= amplitude stress. As a result, $\sigma max=125$ kgf/mm$^2$ was obtained.

Comparison of fatigue strength:

It is appreciated that Example 2 is increased in fatigue strength by the amount of 165−125=400 kgf /mm$^2$.

(3) X-ray (Cuk alpha ray) was irradiated on the surface layers of the wave spring having been treated with the shotting by means of fine particles of a diameter of 0.05 mm according to Example 2, and of the wave spring having been treated with shotting by means of steel shots of a diameter of 0.3 mm according to Comparative 2, so as to conduct an X-ray diffraction inspection.

It was found that, on the surface of the workpiece having been rolled or spring formed (rolled surface) before shotting, (200)<110> aggregate structure has been developed which is usually found when alpha steel is rolled. Specifically, (200) plane in parallel with the rolled surface was predominantly oriented, and <110> plane in the rolling direction was predominantly oriented.

It is noted, however, that, when the shottings according to Example 2 and Comparative 2 are performed relative to the workpiece, (110) plane of alpha steel is predominantly oriented on the rolled surface, and the predominant plate of <110> direction (rolling direction), as existed in the rolled condition, has disappeared.

It is specifically pointed out that the aggregate structure of alpha steel due to the shotting is well developed in the case of the prior art shotting than the fine particle shotting of the invention. This is because that, according to prior art shotting, the coverage of shotting is sufficiently increased due to the prolonged time (30 min.) of shotting, so that a plurality of shots are repeatedly ejected. Such combined effects greatly contribute to development of the aggregate structure. On the contrary, and in accordance with the invention, the shotting time is merely 13 seconds, so that the aggregate structure is not sufficiently developed as compared to the prior art shotting, although coverage of more than 100% may be obtained.

It is recognized from the same X-ray diffraction that, although the peak of (110) (200) (211) of alpha steel is slightly changed in its location due to creation of macroscopic residual stress, significant change of the peak in its location as is found by creation of martensite is not recognized. It is noted, however, that the change of the diffraction peak in its location of the Example 2 is greater than that of Comparative 2. It is also found that increased amount of residual compressive stress is created in the surface layer.

From the structural observation of the surface layer by means of a scanning electron microscope, it is found that Example 2 and Comparative 2 both show the same metallic structure in the area few micrometers deep from the surface layer. Martensite structure and adiabatic shear band are not found in Example 2. Accordingly, it may be concluded that the shotting treatment according to Example 2 is performed under appropriate condition.

It is obvious from the result of determining hardness distribution of the surface layer, the result of the electron-microscopic observation, and the result of the measurement of residual stress, that Example 2 is more effective than Comparative 2, although its effect of shot peening is restricted to shallow area.

ADVANTAGES OF THE INVENTION

In accordance with the invention, the effect of shot peening is restricted to a relatively shallow area, by reason of using smaller particles. It is noted, however, that increased amount of hardening due to the work hardening of the surface layer and an increased amount of residual compressive stress may be applied to a workpiece. Surface roughness is also reduced, so that stress concentration due to depressions on the surface may be reduced. These effects in combination greatly contribute to obtaining superior fatigue-resistance. It is specifically noted that shot peening is performed by controlling the upper limit of temperature rising in the surface of a workpiece to a temperature above 150 degree Celsius but below the temperature at which recovery recrystallization and austenitizing of steel occurs. This contributes to prevention of occurrence of adiabatic shear band and subcooled structure of martencite and banite. The use of fine particles causes cementite to be finely fractured, so as to increase the yield strength by reason of significant creation of free carbon atoms and dislocation anchoring, so that fatigue-resistance may be greatly increased as compared with prior art shot peening.

It will further be obvious to those skilled in the art that many variations may be made in the above embodiments, here chosen for the purpose of illustrating the present invention, and full result may be had to the doctrine of equivalents without departing from the scope of the present invention, as defined by the appended claims.

We claim:

1. A surface treatment method for a steel workpiece comprising the steps of impinging a plurality of particles of hard metal having a diameter ranging from 20 to 100 micrometers onto a surface of the workpiece at a speed greater than 80 m/second, and controlling a temperature rise of the surface of the workpiece resulting from said impinging to a range of from greater than 150 degrees Celsius to less than the temperature at which recovery recrystallization of steel occurs.

2. A surface treatment method for a steel workpiece according to claim 1 further comprising the step of restricting the temperature rise of the workpiece surface to below an upper temperature limit of dislocation anchoring.

3. A surface treatment method for a steel workpiece according to claim 1, wherein the step of impinging a plurality of particles comprises the step of ejecting metal particles using air or another gas as a carrier.

4. A surface treatment method for a steel workpiece according to claim 1, wherein the step of impinging a plurality of particles further comprises the step of ejecting metal particles having a diameter ranging from 20 to 60 micrometers onto a thin plate spring.

5. A surface treatment method for a steel workpiece comprising the steps of ejecting shot particles having a diameter ranging from 100 micrometers to 1.0 mm onto a surface of the steel workpiece, wherein residual compressive stress is applied to the area 0.05 mm to 0.5 mm deep from the surface of the workpiece, thereafter impinging a plurality of particles of hard metal having a diameter ranging from 20 to 100 micrometers onto the surface of the workpiece at a speed greater than 80 m/second, and controlling a temperature rise of the surface of the workpiece resulting from said impinging to a range of from greater than 150 degrees Celsius to less than the temperature at which recovery recrystallization of steel occurs.

6. A surface treatment method for a steel workpiece comprising the steps of ejecting shot particles having a diameter exceeding 300 micrometers onto a coil spring at a speed less than 100 m/second, then ejecting shot particles having a diameter exceeding 100 micrometers but less than 300 micrometers onto the workpiece, so as to improve the surface roughness of the workpiece and residual compressive stress, and thereafter, impinging a plurality of particles of hard metal having a diameter ranging from 20 to 100 micrometers onto a surface of the workpiece at a speed greater than 80 m/second, and controlling a temperature rise of the surface of the workpiece resulting from said impinging to a range of from greater than 150 degrees Celsius to less than the temperature at which recovery recrystallization of steel occurs.

7. A surface treatment method for a steel workpiece according to any one of claims 1 to 6, further comprising the step of performing the method while external stress is exerted to the surface of the steel workpiece.

8. A surface treatment method for a steel workpiece according to any one of claims 1 to 6 further comprising the step of cold setting or warm setting the workpiece.

9. A surface treatment method for a steel workpiece according to claim 7 further comprising the step of cold setting or warm setting the workpiece.

10. A surface treatment method for a steel workpiece according to any one of claims 1 to 6 further comprising the step of cold tempering the workpiece.

11. A surface treatment method for a steel workpiece according to claim 7 further comprising the step of cold tempering the workpiece.

12. A surface treatment method for a steel workpiece according to claim 8 further comprising the step of cold tempering the workpiece.

13. A surface treatment method for a steel workpiece according to claim 9 further comprising the step of cold tempering the workpiece.

* * * * *

UNITED STATES PATENT AND TRADEMARK OFFICE

CERTIFICATE OF CORRECTION

PATENT NO : 5,816,088

DATED : October 6, 1998

INVENTOR(S): Yoshiro Yamada; Masaaki Ishida

It is certified that error appears in the above-identified patent and that said Letters Patent is hereby corrected as shown below:

In column 4, line 57, change "v=80 m/sec" to --v=180 m/sec--.

In column 4, line 63, change "3x107" to --$3X10^7$--.

In column 5, line 24, change "637=588=49 (Mpa)" to --637-588=49 (Mpa)--.

Signed and Sealed this

Eleventh Day of April, 2000

*Attest:*

*Attesting Officer*

Q. TODD DICKINSON

*Director of Patents and Trademarks*